United States Patent [19]

Hirotsu

[11] Patent Number: 4,466,366

[45] Date of Patent: Aug. 21, 1984

[54] METHOD OF TUFTING CUT PILE AND LOOP PILE IN THE SAME ROW OF STITCHING

[75] Inventor: Toshiaki Hirotsu, Osaka, Japan

[73] Assignee: Haniisuchiiru Co., Ltd., Japan

[21] Appl. No.: 465,795

[22] Filed: Feb. 11, 1983

[30] Foreign Application Priority Data

Feb. 12, 1982 [JP] Japan ..... 57-21901
Jul. 27, 1982 [JP] Japan ..... 57-131053

[51] Int. Cl.[3] ..... D05C 15/00
[52] U.S. Cl. ..... 112/79 R
[58] Field of Search ..... 112/79 R, 79 F

[56] References Cited

U.S. PATENT DOCUMENTS 1,907,292 5/1933 Gladish ..... 112/79 A
2,982,240 5/1961 McCutchen ..... 112/79 R
2,990,792 7/1961 Nowicki et al. ..... 112/79 A
3,618,543 11/1971 Wittler ..... 112/79 A
4,185,569 1/1980 Inman ..... 112/79 R

*Primary Examiner*—Ronald Feldbaum
*Attorney, Agent, or Firm*—Darby & Darby

[57] ABSTRACT

In a conventional tufting machine forming cut pile only, a looper is supported in a looper block sliding toward a cooperative needle, and, in each periodic time of tufting reciprocation, it is determined selectively whether a looper is pushed out from a looper block or not and whether a loop of pile yarn is seized thereby at a looper bill releasably or securely. The loop seized releasably is released from a looper and forms loop pile. The loop seized securely is not released from a looper and receives engagement of a looper and a knife to form cut pile. In order to determine selectively whether the looper is pushed out or not, a conventional pattern apparatus can be used.

5 Claims, 5 Drawing Figures

METHOD OF TUFTING CUT PILE AND LOOP PILE IN THE SAME ROW OF STITCHING

BACKGROUND OF THE INVENTION

This invention relates to a tufting method of selectively forming cut pile and loop pile in the same row of stitching in a backing fabric.

In U.S. patent of R. T. Card, U.S. Pat. No. 3,084,645, a method and apparatus for tufting cut pile and loop pile in the same row of stitching is disclosed. In that method, selective forming cut pile and loop pile depends on the pressure between a looper and a spring clip which is secured on the side face of the looper and is placed in a clearance between the arranged two loopers.

In U.S. patent of Paul E. Jolley and Robert T. Crumbliss, U.S. Pat. No. 4,134,347, a method and apparatus for tufting even level cut pile and loop pile in the same row of stitching is disclosed. In that method, selective forming cut pile and loop pile depends on selective opening and closing a gate which is constructed with a looper (hook) and a gate member placed in a clearance between the arranged two loopers.

But, so the finer a gauge of stitching row and the narrower a clearance between loopers, it is difficult to place a spring clip and a gate member between loopers, and it makes the gauge parts expensive to mount pivotably a gate member on the side of the looper like as a shears, a pinchers or a nippers, and further, such a gate member makes a tufting machine to be complicated and to be hard to deal with.

SUMMARY OF THE INVENTION

The present invention provides a simple and reliable method for forming tufted fabrics having a pattered arrangement of cut pile and loop pile in any row of stitching by seizing selective loops of pile yarn from a needle at a portion of the adjacent free end of the looper bill or at the inner portion from the free end of the looper bill.

In practicing the principles of the present invention, in each periodic time of cooperative engagement between a plurality of needles and a plurality of loopers, and a plurality of loopers and a plurality of knives that have reciprocal movement driven by conventional means, each looper is controlled and determined respectively and selectively for its cooperative needle to cross slightly or closely. A looper determined to cross a needle slightly seizes a loop of pile yarn carried by a needle through the base fabric at a portion adjacent of the free end of the looper bill, and so, a loop is released very easily from a looper and forms loop pile.

On the other side, a looper determined to cross a needle closely seizes a loop of pile yarn at a portion of the looper bill which is inner from the free end, so a loop cannot be released from a looper and receives engagement with a looper and a knife and forms cut pile.

In the present invention, there are provided a plurality of vertical thin through slits on the front side of the looper block to push in a shank of a looper, and a plurality of loopers are arranged and supported slidingly toward respective needles in these slits. Of course, a looper block is driven reciprocably toward a needle by conventional means such as a link and carries a plurality of loopers toward a plurality of needles to cross slightly them respectively, and loop pile is formed.

When letting a selected looper cross a needle closely to form cut pile, a looper is pushed out from a slit of a looper block by conventional drive means such as a cam, a link and a cylinder through the medium such as a rod, a wire and air etc. Like as above description, in the present invention, it need not the sub-gauge-parts such as a spring clip and a gate member to form cut pile and uncut loop pile selectively in the same row of stitching.

Consequently, it is a primary object of the present invention to provide a simple and reliable method and apparatus for forming tufted fabrics having cut pile and loop pile in the same row of stitching.

It is another object of this invention to provide a fine gauge tufted fabric having cut pile and loop pile in the same row of stitching.

BRIEF DESCRIPTION OF THE DRAWINGS

Further objects and advantages of the invention will be apparent from the following description taken in conjunction with the drawings, wherein.

DETAILED DESCRIPTION OF THE PREFERRED EMBODIMENT

Figure 1:
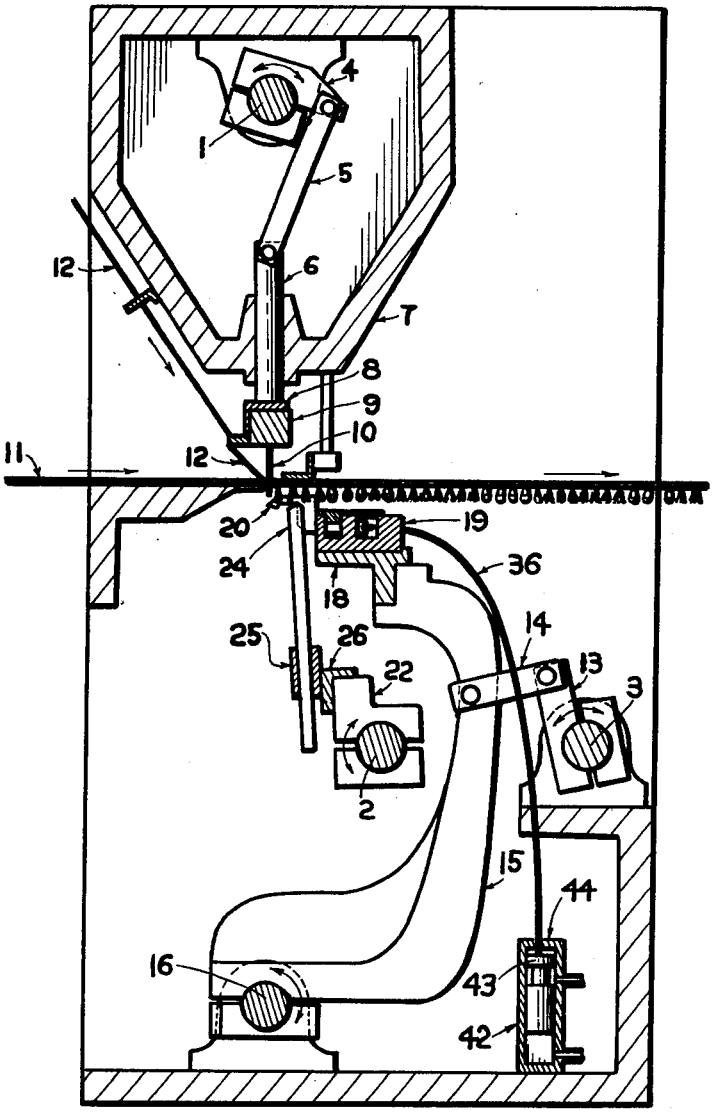
FIG. 1 is a fragmentary vertical section view taken transversely through a multiple needle tufting machine embodying apparatus constructed in accordance with the principles of the present invention.

Referring now to the drawings, there is illustrated in FIG. 1 a needle shaft 1, a knife shaft 2 and a looper shaft 3 oscillatorily rotated in timed relationship with each other by conventional drive means such as a cam and lever means from a main shaft (not shown).

In FIG. 1, 4 is a rocking arm secured to the needle shaft 1, and is pivotably connected to a push rod 6 with a connecting link 5. A needle bar 8 is mounted on the lower end of the push rod 6 riding in a bearing in an upper flame 7 to slide longitudinally. So that, when the needle shaft 1 is oscillatorily rotated, a plurality of needles 10 one being shown that are mounted in a needle block 9 and fixed at the bottom of a needle bar 8 to penetrate a base fabric 11 are all reciprocably driven through the medium of the cam 4, the link 5 and push rod 6 and each needle carried a pile yarn 12 to tuft loops on the base fabric 11.

A rocking arm 13 secured to the looper shaft 3 is pivotably connected to an intermediate rocking arm 15 with a connecting rod 14.

The lower end of the rocking arm 15 is clamped to a laterally extending rock shaft 16 mounted rotatively on an pillow bearing 17, and at the upper end of it a looper bar 18 is fixed. A plurality of loopers are arranged removably in a looper block 19 mounted on top of bar 18. So that, when the looper shaft 3 is oscillatorily rotated, a plurality of loopers are reciprocably driven toward a plurality of needles together with the looper block 19 through the medium of the rocking arm 13, the connecting rod 14 and the intermediate arm 15. And at a time when the free end of a looper crosses a needle, its end 58 threads in a loop 21 of pile yarn carried by a needle, and at next time when a needle returns upwardly, the loop 21 is seized by the free end 56 of the bill of the looper (see FIGS. 4 and 5).

Element 22 is a rocking arm secured to the knife shaft 2, and at the front side of the arm a knife bar 26 is fixed, and on the knife bar 26 a plurality of knives 24 extending upwardly are secured to a knife block 25, and the upper end of a knife touches the side of the corresponding looper mounted above it. So that, as the knife bar 26 is reciprocably driven by the knife shaft 2 the knives mounted thereon cooperatively engage with respective loopers 20 to cut the selected loop seized on the various loopers to form cut pile 27 as hereafter described.

Figure 2:
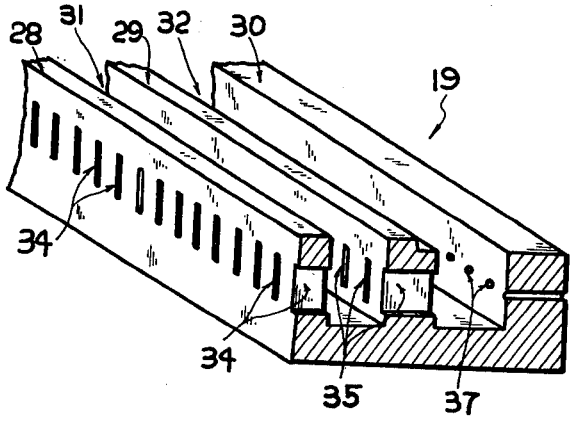
FIG. 2 is a fragmentary perspective view of the looper block illustrated in FIG. 1.
Figure 3:
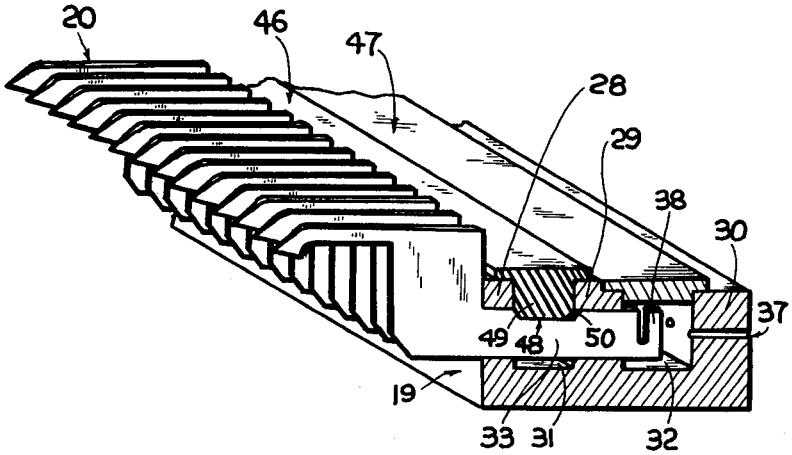
FIG. 3 is a fragmentary vertical sectional view of a portion of the tufting machine illustrated in FIG. 1, but enlarged to show the looper and the looper block.

In the preferred embodiment, as illustrated in FIGS. 2 and 3, there are three flanges 28, 29 and 30 on the upper side of the looper block 19 paralled to each other and laterally extending, and two paralled channels 31 and 32 are provided between them.

On front flange 28 and middle flange 29, a plurality of vertical thin through slits 34 and 35 are provided at the same regular interval as the gauge of row stitching for a shank 33 of the looper 20 to push in and be slidingly supported.

On a back flange 30, a plurality of small through holes are provided each hole being in a straight line extending from two slits 34 and 35 to pass a wire 36 through.

The back end 38 of the shank 33 of each looper (see FIGS. 3-5) is pushed in the slits 34 and 35 and is pivotably connected with a pin 39 to a connecting piece 40 which is connected to the end of the wire 36. The other end of each wire 36 is connected to a movable cylinder head 43 of a cylinder 42, and the wire 36 is covered slidingly in a flexible sheath 45 from a fixed cylinder head 44 to the back flange 30 of the looper block. So that, each looper 20 is reciprocably driven toward the needle 10 not only with oscillatory movement of the looper shaft 3, looper bar 18 and block 19 but also by reciprocal movement of the cylinder head 43 through the medium of the wire 36 like as pushed out and back for the looper block 19.

Each of the two channels 31 and 32 is covered with lids 46 and 47 respectively. Besides, at the underside of the front lid 46 a laterally extending ridge 49 is provided to stick in the front channel 31, and a recess is provided on the middle portion of the upper end of the looper shank 33 and exposed in the front channel 31, the length c of which recess is longer than the width b of the channel or the ridge. So that, there is provided narrow clearance 50 between the ridge and the recess 48 same as the difference ($d=c-b$) between the length c of the recess and the width b of the ridge. And so, reciprocating movement of the looper 20 with a corresponding cylinder 42 is limited to this clearance d since a back edge 52 of the ridge engages the back end 53 of the recess of a looper as it is pushed by a cylinder and the front end 54 the ridge engages the front end 55 of the looper recess as it is pulled back by a cylinder.

At the underside of the free end of the looper extends a protuberance 56. The bottom edge 57 of the protuberance 56 is sloping, and the front end 58 of it is lower than the looper's cutting edge 23, and the back end 59 of it is further low than the front end 58. And the length a of protuberance 56 is longer than the clearance d (the distance of looper travel) as before described. ($a>d$)

Figure 4:
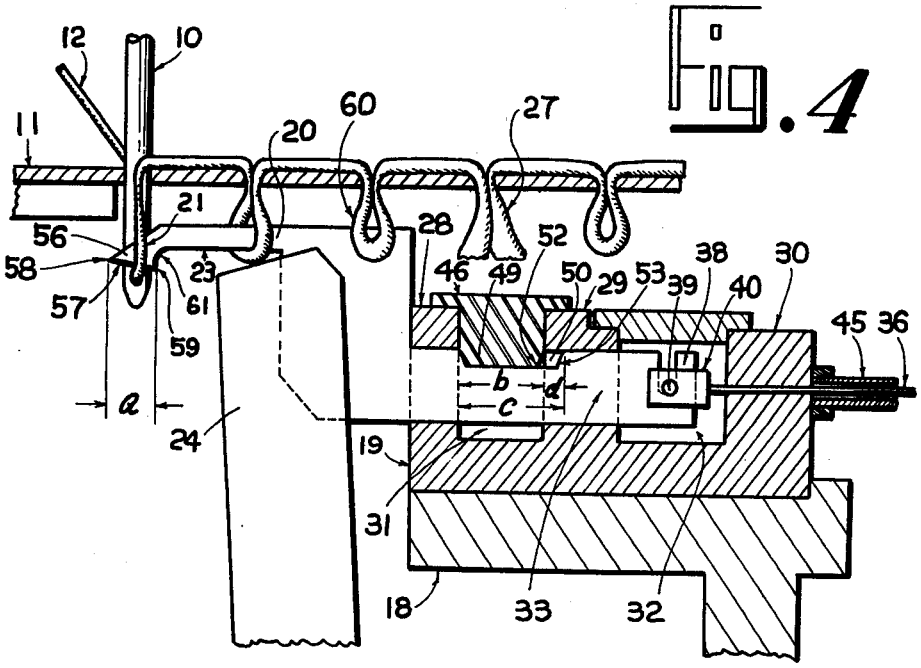
FIG. 4 is an enlarged vertical sectional view of an operative position of the looper relative to the needle, and wherein the looper threads through a loop of pile yarn slightly.

Reciprocating movement of the looper 20 is adjusted so that the bill of the looper crosses a needle 10 slightly and the back end 59 of the protuberance 56 does not cross a needle 10 when the looper is driven with only the looper shaft 3, as illustrated in FIG. 4. So that, if the cylinder 42 connected to a looper does not act, the loop 21 of pile yarn is seized at a portion of the bottom edge 57, and at next time when the needle 10 returns upwardly and the looper returns backwardly, the loop 21 released from the free end 58 of the looper and does not receive engagement with the looper 20 and the knife 24, and forms loop pile.

Figure 5:
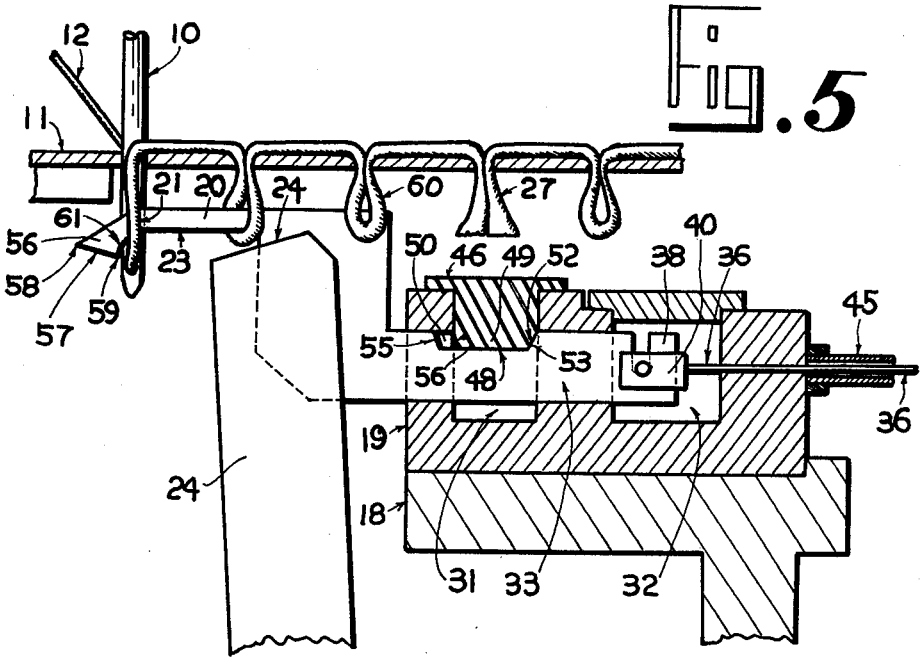
FIG. 5 is an enlarged vertical sectional view of an operative position of the looper relative to the needle, and wherein the looper threads through a loop of pile yarn deeply.

But, as illustrated in FIG. 5, at a time when the bill 58 of the looper 20 driven with the looper shaft 3 crosses the needle 10 and threads into a loop 21, if a looper 20 is pushed out from the looper block 19 by its cylinder 42 and crosses the needle so closely as the back end 59 of the protuberance 56 to cross the needle, the loop 21 is seized at a portion of the cutting edge 23. At the next time when the needle returns upwardly even if the looper 20 returns backwardly with the looper shaft 3 and the cylinder 42, the loop is seized, or hung, on the back edge 61 of the protuberance 56, a loop can not be released from the looper 20. So that when the machine has advanced through one more cycle the seized loop is carried by the movement of the base fabric 11, as shown by the direction of the arrow to the inner part of the cutting edge 23 like the loop shown adjacent the knife in FIGS. 4 and 5. At the next periodic time of tufting, this loop is cut by the engagement of the knife 24 associated with the respective looper to form cut pile 27.

By the above description and drawings it is understood that when a pile yarn 12 is supplied to each needle 10 by any convenient type of yarn feed mechanism and the cylinder 42 is respectively controlled in each row of stitching by well known pattern reading and signaling mechanism, the same pile height of cut pile and loop pile is selectively formed in the same row of stitching.

Having thus set forth the nature of this invention, what is claimed herein is:

1. A tufting machine comprising:

a plurality of needles each feeding a respective yarn, means for driving said needles in common in reciprocating motion through a base fabric to form a loop upon movement through and out of said base fabric, a plurality of loopers, each looper being associated with a corresponding needle, means for driving said plurality of loopers in common in reciprocating motion toward and away from said plurality of needles, each said looper having a portion defining a cutting edge and a front bill which extends into the loop between the yarn and the needle when said looper drive means moves said loopers toward said needles, a plurality of knives, each knife being associated with the cutting edge of a respective looper, means for driving said plurality of knives in common toward and away from the cutting edges of said loopers, a control means connected to each looper for selectively extending the looper further toward its corresponding needle and the loop formed thereby a said looper drive means extends the looper alone when the control means is actuated and for retracting the looper away from the loop, each said looper when moved to its extending position by its control means seizing the yarn loop when said control means and said looper driving means are both at their retracted positions so that the seized loop is moved to the cutting edge portion of the looper for engagement by the respective knife as said knives are moved toward the loopers by said knife drive means.

2. A tufting machine as in claim 1 wherein said front bill of each said looper is formed to withdraw from the respective loop when the control means is unactuated and the looper drive means drives said loopers away from said needles.

3. A tufting machine as in claim 2 wherein the front bill of each looper extends downwardly from said cutting edge portion has a bottom edge which slopes downwardly from the end of the bill rearwardly toward said cutting edge portion.

4. A tufting machine as in claim 3 where said control means extends its connected looper for a distance which is less than the length of the bottom edge of the looper.

5. A tufting machine comprising:

a plurality of needles each feeding a respective yarn, means for driving said needles in reciprocating motion through a base fabric to form a loop upon movement through and out of said base fabric;

a plurality of loopers, each being associated with a corresponding needle, means for selectively driving said plurality of loopers toward and away from said plurality of needles, each said looper having a portion defining its cutting edge and a front bill which extends into the loop between the yarn and the needle when said looper drive means moves said looper toward said needle;

a plurality of knives, each knife being associated with the cutting edge of a respective looper, means for driving said plurality of knives in common toward and away from the cutting edges of said loopers; and control means connected to each looper for individually controlling the extension of the looper further towards its corresponding needle so that it crosses its corresponding needle closely or slightly in a selected tufting cycle thereby selectively forming a cut pile and a loop pile in the same row of stitching;

wherein each said looper when moved to its extending position by its control means seizing the yarn loop when said control means and said looper driving means are both at the retracted positions so that the seized loop is moved to the cutting edge portion of the looper for engagement by the respective knife as said knives are moved toward the loopers by said knife drive means.

* * * * *